United States Patent [19]

Seymour

[11] 4,207,048

[45] Jun. 10, 1980

[54] POWER PRESSES AND COMPONENTS FOR SUCH PRESSES

[76] Inventor: Eric W. Seymour, Farleigh, Claremont La., Esher, Surrey, England

[21] Appl. No.: 973,291

[22] Filed: Dec. 26, 1978

[30] Foreign Application Priority Data

Jan. 5, 1978 [GB] United Kingdom ..... 369/78

[51] Int. Cl.[2] ..... B30B 15/00

[52] U.S. Cl. ..... 425/151; 425/406

[58] Field of Search ..... 425/383, 384, 385, 394, 425/398, 399, 406, 151

[56] References Cited

U.S. PATENT DOCUMENTS

| | | | |
|---|---|---|---|
| 2,478,165 | 8/1949 | Collins | 425/394 X |
| 2,578,209 | 12/1951 | Schwarz | 425/394 X |
| 2,907,070 | 10/1959 | Van Hartesveldt | 425/384 |
| 3,173,190 | 3/1965 | Brown | 425/398 X |
| 3,311,692 | 3/1967 | Baird | 425/384 X |
| 3,475,521 | 10/1969 | Stroop | 425/398 X |
| 3,509,246 | 4/1970 | Borgardt | 425/398 X |
| 3,743,463 | 7/1973 | Patrick et al. | 425/384 X |
| 3,819,315 | 6/1974 | Bouchard et al. | 425/383 |
| 3,945,790 | 3/1976 | Pueck | 425/383 X |
| 4,018,552 | 4/1977 | Prast et al. | 425/384 X |

FOREIGN PATENT DOCUMENTS

| | | | |
|---|---|---|---|
| 6610318 | 10/1966 | Fed. Rep. of Germany | 425/151 |
| 2531956 | 2/1977 | Fed. Rep. of Germany | 425/151 |

*Primary Examiner*—J. Howard Flint, Jr.

*Attorney, Agent, or Firm*—Sughrue, Rothwell, Mion, Zinn and Macpeak

[57] ABSTRACT

A power press in which a ram is driven towards and away from a press bed so that, in use, a work piece is deformed by a tool mounted between the ram and the press bed is provided with means by which a jam in the press can be released both quickly and simply, this release means comprising a layer of heat softenable rigid plastics material which is located in the press so that the direction of the press stroke is substantially normal to the layer and so that during a pressing operation the layer is subjected to compressive stress in the direction of press stroke, and electrical heating means located so that it is capable of heating the layer of plastics material, when desired, to a temperature sufficient for the plastics material to soften whereby, under compression in the direction of the press stroke, the thickness of the plastics layer decreases. Preferably the electrical heating means comprises an element which is embedded in a metal layer which fits face to face with the plastics layer, and is preferably sandwiched between two plastics layers, to form a spacer assembly which is fitted in the press, usually between the tool and the ram, or between the tool and the press bed.

7 Claims, 6 Drawing Figures

POWER PRESSES AND COMPONENTS FOR SUCH PRESSES

This invention relates generally to power presses in which a ram is driven towards and away from a press-bed so that, in use, a work-piece is deformed by a tool which is mounted between the ram and the press-bed, including presses such as press-brakes in which one or more rams are driven to move a press beam towards and away from the press-bed. Usually the tool comprises two parts, sometimes known as die-sets, which, in use, are attached one part to the ram and the other part to the press-bed, and which are usually provided with telescopic guides which allow the parts to move towards and away from each other under the action of the ram without altering their attitudes relative to each other.

Obviously, different tools are required for different pressing operations, and in order to adapt the effective stroke of the press to suit a particular tool and the work-piece which is to be pressed, it is usual to mount the tool in position with one or more spacers clamped between the tool and the ram or, more commonly, between the tool and the press-bed. The spacers, which are sometimes referred to as parallels, are usually steel plates which have accurately machined parallel upper and lower faces, and are made to whatever shape and thickness is required.

The ram of the press is usually reciprocated by means of a crank-shaft acting through a connecting rod, the crank-shaft being driven by a motor through a clutch and a flywheel at one end of the crank-shaft. With this arrangement a press stroke is completed at the bottom dead centre position of the crank-shaft, and the correct setting of the press is essential in order to achieve an efficient pressing operation.

A rough setting is achieved by the use of spacers, as mentioned above, and a fine setting is achieved by means of an adjustment screw in the connection between the ram and the crankshaft. Any error in setting up the press or in the thickness of the work-piece fed to the press, in one sense, will simply result in an imperfect pressing of the work-piece. Any error in the opposite sense however, may cause the tool to jam on the work-piece before the bottom of the press stroke is reached. This causes the whole press to jam solid, and sometimes even to break, which is of course very expensive in terms of the cost of the repair or replacement and in lost production. Even if the press has not broken it is often a very laborious, lengthy and therefore expensive, task to unjam the press since in most presses there is no easy way of increasing the clearance between the parts of the tool which are jammed on the work-piece. The axial forces generated in the ram by the jam prevent retraction of the ram by means of the adjusting screw, and because of the arrangement of the clutch and flywheel it is extremely difficult to wind back the crank-shaft in order to retract the ram. Consequently, it is often necessary to dismantle the press sufficiently to remove the crank-shaft in order to release the jam and it has been known even to cut through the adjusting screw, which of course means that a replacement adjusting screw must be fitted before the press can be re-used.

The aim of the present invention is to provide a means by which such jams in power presses can be released in a much simpler and quicker manner, and without inflicting any further damage on the press over and above that which may have been caused when the jam occurred.

To this end, according to the invention a power press in which a ram is driven towards and away from a press-bed so that, in use, a work-piece is deformed by a tool which is mounted between the ram and the press-bed, includes a layer of heat softenable rigid plastics material located so that the direction of the press stroke is substantially normal to the layer and so that during a pressing operation the layer is subjected to compressive stress in the direction of the press stroke, and also includes electrical heating means which is capable of heating the layer of plastics material to a temperature sufficient for the plastics material to soften whereby, under compression in the direction of the press stroke, the thickness of the plastics layer decreases.

With this arrangement, when the press jams as a result of the tool not clearing the work-piece, all that is necessary is to connect the electrical heating means to a suitable source of electrical power and wait for the plastics layer to be heated until it softens sufficiently for it to become squashed thinner under the axial compression forces generated by the jam. As the plastics layer becomes squashed, the distance between the parts of the tool engaging the work-piece increases correspondingly so that the jam is released and the work-piece can be removed in the normal way. The plastics layer, or the component incorporating this layer, is then replaced and the press is re-set correctly for resumption of pressing operations. This whole procedure may be carried out by a single person in a matter of minutes rather than the hours or even days which it often takes more than one person to unjam and reset a conventional press.

The plastics layer may be located in the ram, in the press-bed, or in the tool, but usually it will be located between the tool and the ram or between the tool and the press-bed, the layer forming a spacer or part of a spacer assembly.

The electrical heating means is preferably located in a metallic body lying face to face with the plastics layer. Depending on where the plastics layer is located, the metallic body may be part of either the ram, the press-bed, or the tool, but preferably it is a metal layer which, together with the plastics layer, forms a spacer assembly or part of a spacer assembly which is inserted in the press.

According to another aspect of the present invention, a spacer assembly for use in the power press comprises a layer of heat softenable rigid plastics material face to face with a metal layer which contains electrical heating means which is capable of heating the metal layer to a temperature sufficient for the plastics layer to soften whereby the thickness of the plastics layer (and also the spacer assembly) decreases when the spacer assembly is subjected to sufficient compression in a direction normal to the layers, the outer faces of the spacer assembly being parallel to each other.

Preferably the spacer assembly comprises an additonal layer of heat softenable rigid plastics material, the metal layer containing the electrical heating means being sandwiched between the two plastics layers. With this arrangement the two plastics layers insulate the metal layer containing the electrical heating means from the parts of the press between which the spacer assembly is located, and therefore the majority of the heat generated in the metal layer is transferred to the plastics layers as desired, instead of some of it being lost to the adjacent parts of the press. Nevertheless, if preferred, the spacer assembly may instead comprise an additional layer of metal so that the plastics layer is sandwiched between the two metal layers, and in this case either or both of the metal layers may contain electrical heating means.

The metal layer or layers will usually be made of steel or aluminium, but may be of any other suitable metal if preferred. The plastics layer or layers may be of any suitable plastics or plastics based material which is rigid and substantially incompressible at normal machine shop temperatures and which can be heated to a temperature at which the material softens and can be deformed under pressure. It is considered that a particularly suitable plastics material is polycarbonate, this beginning to soften at about 140° C. and reaching a substantially molten state at about 270° C. The metal and plastics layers forming the spacer assembly may be firmly connected together as a unit, such as by adhesive bonding or by being screwed or bolted together in such a way that the thickness of the plastics layer or layers, and therefore of the spacer assembly, is able to decrease as required. Alternatively, it may be preferred to leave the layers of the spacer assembly unconnected to facilitate replacement of the plastics layer or layers after being heated and deformed to release a jam. When the spacer assembly is located in the press, its layers will be clamped firmly together, although, if desired, locating means may be provided to prevent the layers from moving laterally with respect to each other. Various examples of spacer assemblies and presses in accordance with the invention will now be described with reference to the accompanying drawings, in which:

Figure 2:
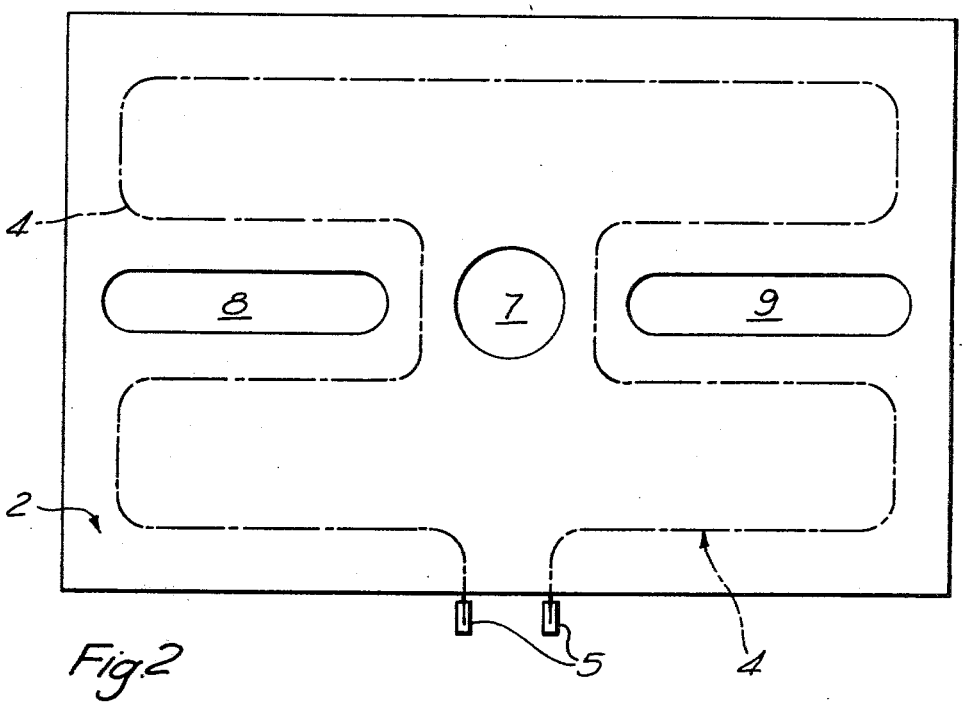
FIG. 2 is a plan view of the spacer assembly shown in FIG. 1.
Figure 3:
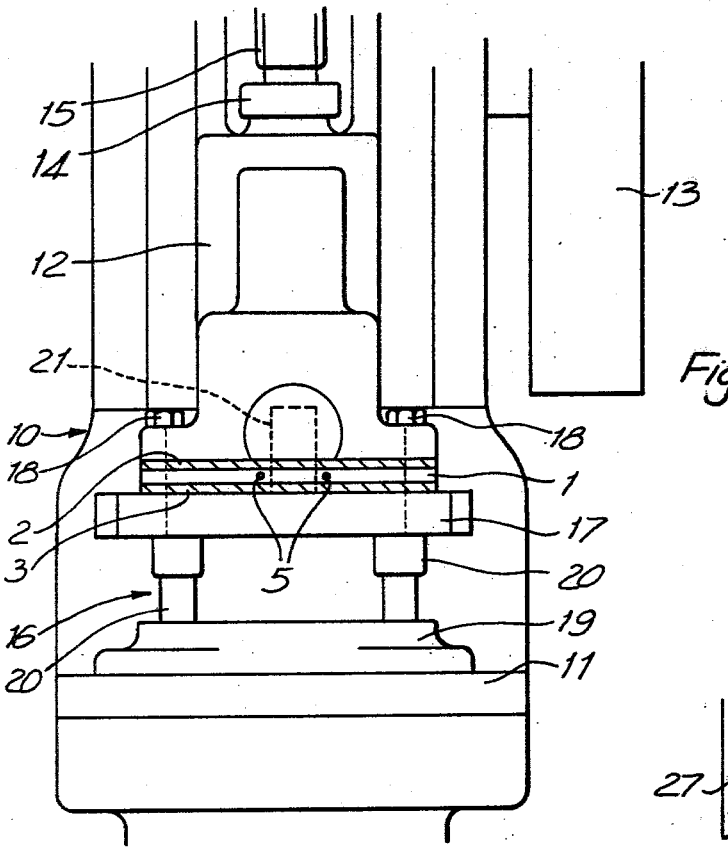
FIG. 3 is a diagrammatic front view of part of one example of a press incorporating a spacer assembly similar to that shown in FIGS. 1 and 2.
Figure 5:
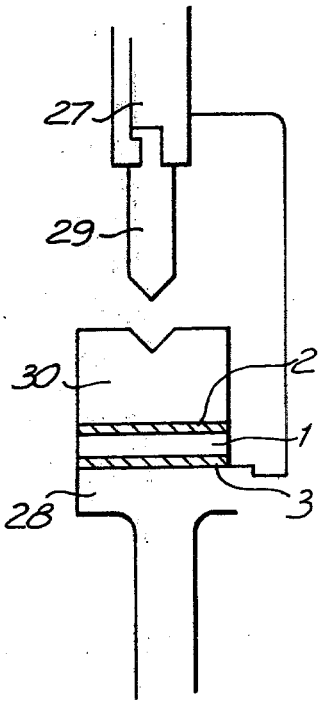
Figure 6:
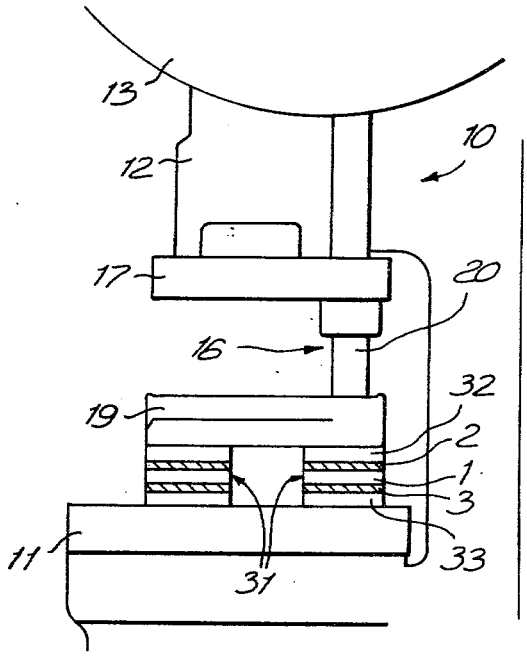

FIG. 5 is a diagrammatic side view illustrating how the invention may be applied to a press-brake; and, FIG. 6 is a diagrammatic side view of a press which is similar to that of FIG. 3 but which incorporates a different form of spacer assembly. The spacer assembly shown is FIGS. 1 and 2 comprises a rectangular layer 1 of aluminum, sandwiched between two similar, but thinner, rectangular layers 2 and 3 of polycarbonate. As mentioned earlier, polycarbonate is a plastics material which is rigid and incompressible at machine shop temperatures but which will soften when heated to a temperature above 140° C. Embedded in the aluminum layer 1 is an electrical heating element 4 having terminals 5 projecting from one edge of the layer for the purpose of connecting the element 4 to a suitable electrical power supply. The element 4 is arranged to heat the layer 1 substantially evenly throughout and to a temperature sufficient for the polycarbonate layers 2 and 3 in contact with the aluminum layer 1 to soften whereby the thickness of the layers 2 and 3, and therefore the overall thickness of the spacer assembly, will decrease if the assembly is subjected to sufficient compression in a direction normal to the layers 1, 2 and 3 as indicated by the arrows 6. In this example the layers 1, 2 and 3 of the assembly have a central hole 7 extending through the layers, and a pair of slot-like openings 8 and 9 arranged on opposite sides of the central hole 7 as shown in FIG. 2 and also extending through the layers. The central hole 7 is provided to accommodate the shank or spigot of a tool in the case when the spacer assembly is located between the tool and the ram of a press, and the slot like openings 8 and 9 are provided to accommodate the bolts by which the tool is fixed to the ram. As will be appreciated, the size of any spacer assembly, and the presence and positioning of the holes 7, 8 and 9, particularly the bolt holes 8 and 9, will depend upon the size and arrangement of the press in which the spacer assembly is to be used and on where the assembly is to be fitted in the press.

Figure 1:
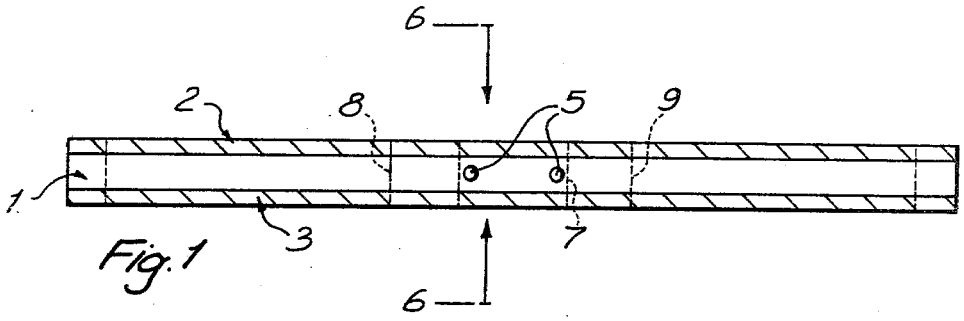
FIG. 1 is a side elevation of one example of a spacer assembly.

A press fitted with a spacer assembly arranged as shown in FIGS. 1 and 2 is illustrated in FIG. 3. The press comprises a press body 10 providing a horizontal press bed 11, and a ram 12 which is movable vertically towards and away from the press bed 11 in guides (not shown) on the press body 10. The ram 12 is reciprocated up and down by means of a driving mechanism (not shown) comprising a crank shaft which is driven by a motor through a clutch and a flywheel (part of which is shown at 13) and which is connected to the ram at 14 by a connecting rod having an adjusting screw 15 for fine adjustment of the press stroke. Mounted between the ram 12 and the press bed 11 is a press tool 16 comprising an upper die set 17 which is bolted to the ram 12 as shown at 18, a lower die set 19 which is bolted to the press bed 11, and telescopic guides 20 between the die sets 17 and 19. The spacer assembly formed by the layers 1, 2 and 3 is clamped between the upper die set 17 and the ram 12, as shown. The bolts 18 fixing the upper die set 17 to the ram pass through the openings 8 and 9 of the spacer assembly, and a spigot 21 which projects from the upper surface of the die set 17 into a socket in the ram 12 passes through the central opening 7 of the spacer assembly.

Figure 4:
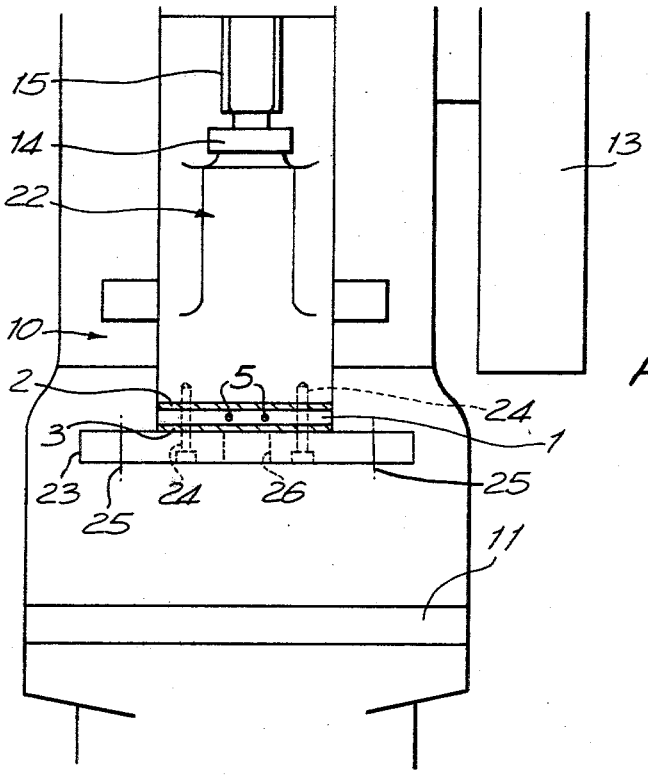
FIG. 4 is a view similar to that of FIG. 3, but showing a different form of press.

The press shown in FIG. 4 differs from that of FIG. 3 in that its ram 22 has a detachable ram plate 23 bolted (as shown at 24) to the main part of the ram at its lower end, and in use the upper die set of a tool (not shown) is bolted to this ram plate 23 at positions 25. In this case, a spacer assembly 1, 2 and 3 is clamped between the ram plate 23 and the main part of the ram 22, and in effect becomes part of the ram, the assembly remaining permanently fixed in position until the plastics layers 2 and 3 need replacing following operation of the assembly to release a jam in the press. The spacer assembly used in the press of FIG. 4 may be similar to that shown in FIGS. 1 and 2, although it may be unnecessary to provide the central opening 7 since the spigot of the tool will project into an opening 26 in the ram plate 23. In other respects, the construction and operation of the press shown in FIG. 4 is similar to that of the press shown in FIG. 3.

FIG. 5 illustrates very diagrammatically a press-brake in which a horizontal press beam 27 is driven vertically towards and away from a horizontal press bed 28. An elongated tool 29 is clamped to the press beam 27 and is arranged to co-operate during a press stroke with a V-block 30 bolted to the press bed 28 to produce an angle section from a metal plate or strip placed between them. In this case, a suitably sized elongated spacer assembly 1, 2 and 3 is clamped between the V-block 30 and the press bed 28.

The press shown in FIG. 6 is similar to that shown in FIG. 3, and corresponding parts have been given the same reference numerals. In this case however, a spacer assembly is not located between the tool 16 and the ram 12, but instead spacer assemblies in the form of parallels 31 are clamped between the lower die set 19 and the press bed 11. Each of the parallels 31 consists of an aluminium layer 1 (containing an electrical heating element) sandwiched between two polycarbonate layers 2 and 3 in much the same way as described with reference to FIGS. 1 and 2, but in addition there are two steel layers 32 and 33 which are face to face with the plastics layers 2 and 3 and which provide the parallel with outer protective faces.

In this case, the layers of each parallel 31 are firmly connected together to form a unit, in contrast to the spacer assemblies used in the other examples described above, in which the layers 1, 2 and 3 are not firmly connected together except when clamped in position in a press.

I claim:

1. In a power press of the kind having a press bed, a ram mounted for movement towards and away from said press bed, means for driving said ram towards and away from said press bed, a tool mounted between said ram and said press bed whereby, in operation, a work piece is deformed by said tool when said ram is driven towards said press bed, said movement of said ram towards said press bed defining a press stroke, and a jam release assembly mounted in said press, said assembly comprising a layer of heat softenable rigid plastics material located so that the direction of said press stroke is substantially normal to said layer and so that during the pressing operation said layer is subjected to compressive stress in said direction of said press stroke, and electrical heating means which is capable of heating said layer of plastics material to a temperature sufficient for said plastics material to soften whereby, under compression in said direction of said press stroke as a result of a jam, the thickness of said plastics layer decreases to release said jam, the improvement wherein: said jam release assembly includes an additional layer of heat softenable rigid plastics material, said electrical heating means is sandwiched between said two plastics layers, said assembly has parallel outer faces, and said two plastics layers of said assembly are made of polycarbonate.

2. A power press as defined in claim 1, wherein said jam release assembly is located between said tool and said ram.

3. A power press as defined in claim 1, wherein said jam release assembly is located between said tool and said press bed.

4. A power press as defined in claim 1, wherein said ram comprises a first ram part, a second ram part in the form of a detachable ram plate for attachment of said tool to said ram, and means fixing said ram plate to said first ram part, and said jam release assembly is located between said ram plate and said first ram part.

5. A power press as defined in claim 1, wherein said electrical heating means of said jam release assembly comprises a layer of metal and an electrical heating element located in said metal layer.

6. A jam releasing spacer assembly for use in a power press of the kind wherein a ram is driven towards and away from a press bed whereby, in use, a work piece is deformed by a tool which is mounted between said ram and said press bed, said spacer assembly comprising two layers of heat softenable rigid plastics material, a metal layer sandwiched between said two plastics layers and face to face therewith, and electrical heating means located in said metal layer and capable of heating said metal layer to a temperature sufficient for said plastics layers to soften whereby the thickness of said plastics layers decreases when said spacer assembly is subjected to sufficient compression in a direction normal to said layers, said two plastics layers being made of polycarbonate and providing said assembly with outer faces which are parallel to each other.

7. A spacer assembly as defined in claim 6, wherein said assembly further comprises two further metal layers face to face with said plastics layers to form outer protective layers of said assembly, and means firmly connecting said layers together whereby said assembly forms a unit for use as a parallel.

* * * * *